United States Patent [19]

Hartwig

[11] Patent Number: 4,657,485

[45] Date of Patent: Apr. 14, 1987

[54] CEILING FAN GUARD

[76] Inventor: Richard K. Hartwig, 5621 Emerson, Morton Grove, Ill. 60053

[21] Appl. No.: 602,002

[22] Filed: Apr. 19, 1984

[51] Int. Cl.[4] ..... F04D 29/00

[52] U.S. Cl. ..... 416/247 R; 416/5; 362/96

[58] Field of Search ..... 416/5, 170 C, 247 R; 415/121 G, 62; 98/40.08, 40.21; 362/96; 248/230, 225.31

[56] References Cited

U.S. PATENT DOCUMENTS

| | | | |
|---|---|---|---|
| 740,182 | 9/1903 | Rood | 248/230 |
| 956,393 | 4/1910 | Mechling | 248/230 |
| 1,355,145 | 10/1920 | Hoffine | 416/247 R |
| 2,225,406 | 12/1940 | Anderson | 416/247 R |
| 2,571,726 | 10/1951 | Koch | 98/40.21 |
| 3,347,452 | 10/1967 | Radcliffe | 416/170 C |
| 3,787,142 | 1/1974 | Dupke | 416/247 R |
| 4,064,427 | 12/1977 | Hansen et al. | 415/121 G X |
| 4,515,538 | 5/1985 | Shih | 415/62 X |

*Primary Examiner*—Robert E. Garrett
*Assistant Examiner*—Joseph M. Pitko
*Attorney, Agent, or Firm*—Neal J. Mosely

[57] ABSTRACT

A fan guard for ceiling fans comprises a circular grill member supported below the blades of the fan on equally spaced support arms extending radially outward from a clamp attached to the pipe extension suspending the motor housing from the ceiling. The fan guard may be provided with a circumferential open skirt portion, or an enclosed skirt portion interposed between the support arms and the grill. The grill member includes arcuate removable portions for adapting the guard to receive a depending portions of a conventional ceiling fan.

30 Claims, 9 Drawing Figures

CEILING FAN GUARD

BACKGROUND OF THE INVENTION

1. Field of the Invention

This invention relates to fan guards, and more particularly to a fan guard for use on ceiling fans.

2. Brief Description of the Prior Art

Fan guards are known in the art, most of which are designed to be used on portable household fans. There are several patents which disclose fan guards, only one of which is directed for use on ceiling fans.

Cornell, Jr., U.S. Pat. No. 2,022,028 discloses a combined bracket and guard for ceiling fans. The bracket portion is secured on the fan motor housing to clamp the wire guard member thereon.

Viewegh, U.S. Pat. No. 2,498,968 discloses a fan guard mounting. The fan guard comprises a wire guard member secured to the fan motor by telescoping bars.

Kemler, U.S. Pat. No. 2,617,563 discloses a wire fan guard having a base member attached to the fan motor and resiliently receives a removable second grid member. The removable grid member facilitates the mounting operation and allows access to the fan.

Selah, U.S. Pat. No. 2,763,428 discloses a fan safety guard attachment formed of wire mesh. The attachment is adapted to fit over the main guard usually present on fans of the smaller sizes commonly used in homes.

The prior art in general, and none of these patents in particular, disclose a fan guard for ceiling fans having the simplicity of design and ease of installation of this invention.

SUMMARY OF THE INVENTION

It is therefore an object of the present invention to provide an improved guard for conventional ceiling fans.

Another object of this invention is to provide a ceiling fan guard for preventing injury to persons and fan components.

Another object of this invention is to provide a ceiling fan guard of novel construction adaptable to receive depending portions of ceiling fans of differing design.

Another object of this invention is to provide a guard for ceiling fans which is easily assembled and may be installed simply and quickly without removal of the fan.

Another object of this invention is to provide a guard for ceiling fans which is simple in construction and economical to manufacture.

Other objects of the invention will become apparent from time to time throughout the specification and claims as hereinafter related.

The above noted objects and other objects of the invention are accomplished by a fan guard for ceiling fans which comprises a circular grill member supported below the blades of the fan on equally spaced support arms extending radially outward from a clamp attached to the pipe extension suspending the motor housing from the ceiling. The fan guard may be provided with a circumferential open skirt portion, or an enclosed skirt portion interposed between the support arms and the grill. The grill member includes arcuate removable portions for adapting the guard to receive a depending portions of a conventional ceiling fan.

DESCRIPTION OF THE PREFERRED EMBODIMENT

Figure 4:
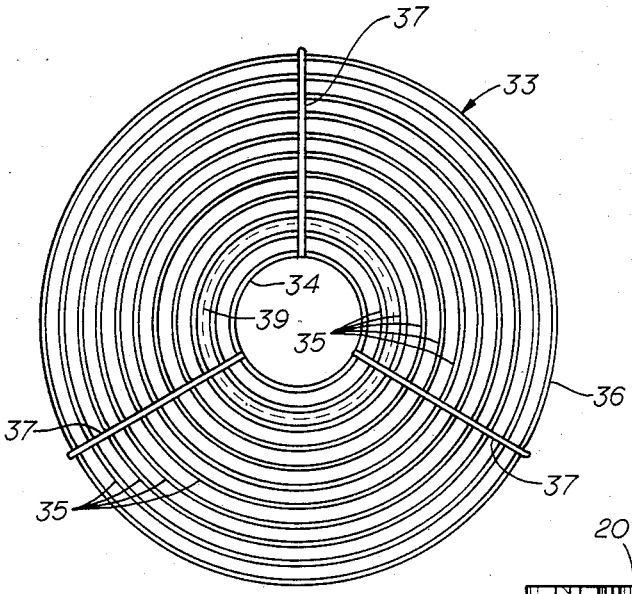
FIG. 4 is a bottom plan view of the ceiling fan guard.
Figure 2:
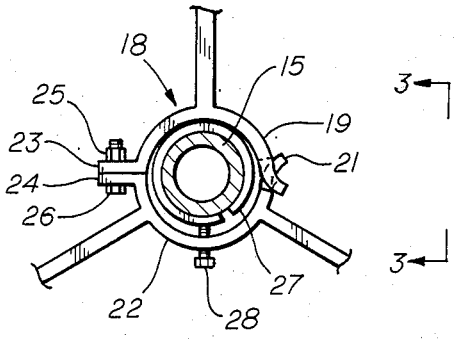
FIG. 2 is a view in horizontal cross sectional on the line 3—3 of FIG. 2.
Figure 3:
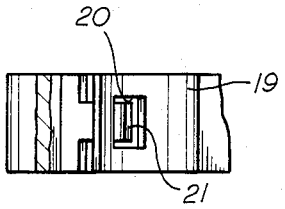
FIG. 3 is a view in side elevation of the guard bracket clamping means taken along line 3—3 of FIG. 2.
Figure 1:
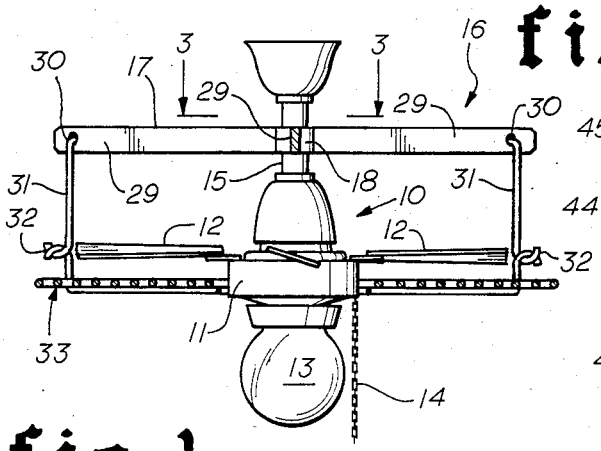
FIG. 1 is a view in side elevation and partially in cross section of one embodiment of a ceiling fan guard installed on a conventional ceiling fan.

Referring to the drawings by numerals of reference, and more particularly to FIG. 1, there is shown a conventional ceiling fan 10 having a motor housing 11, blades 12, light fixture 13 (optional), and speed control chain 14. The fan 10 is suspended from the ceiling by a pipe extension 15 (usually ½" in diameter).

Referring now to FIGS. 1-4, the fan guard 16 comprises a spider member 17 which is secured to the pipe extension 15 above the motor housing 11. The spider 17 comprises a two-piece clamp 18 having one semi-circular segment 19 provided with an opening 20 at one end which receives the tongue portion 21 of a second semi-circular segment 22. The opposed ends 23 and 24 of the clamp segments 19 and 22 are provided with aligned holes to receive a nut 25 and bolt 26. A section of shim material 27 is placed around the pipe extension 15 to prevent damage to the surface, and a set screw 28 is provided in segment 22 for adapting the spider to various pipe diameters.

Three circumferentially spaced support arms 29 of spider 17 extend radially outward from clamp 18 to a point beyond the ends of fan blades 12. Openings 30 are provided at the distal ends of the arms 29 for receiving the hooked end of support wires 31. The lower ends of support wires 31 extend downward to clear the blades 12 and terminate in hooks 32.

A circular grill 33 is formed of a central ring 34 and a series of concentrically spaced rings 35 positioned radially outward therefrom and terminating in an outer ring 36. Three circumferentially spaced connecting wires 37 extend from the central ring 34 across each of the rings 35 to the outer ring 36 and are secured thereto by suitable means such as welding. Each of the extended outer ends of the connecting wires 37 extends upwardly and terminates in a hook 38 which receives the hooked end 32 of support wires 31. In this manner, the circular grill 33 is suspended below the fan blades 12.

By cutting the connecting wires 37 as indicated by dotted line 39 (FIG. 4), any number of rings may be removed for adapting the circular grill 33 to receive the depending portions such as speed control chains 14, light fixtures 13, or motor housings 11 of a variety of fan designs.

The support wires 31 may be supplied with one straight end whereby the user may cut them to a suitable length and hook the ends, or they may be supplied in predetermined lengths. Alternatively, the grid may be formed of molded plastic.

Figure 6:
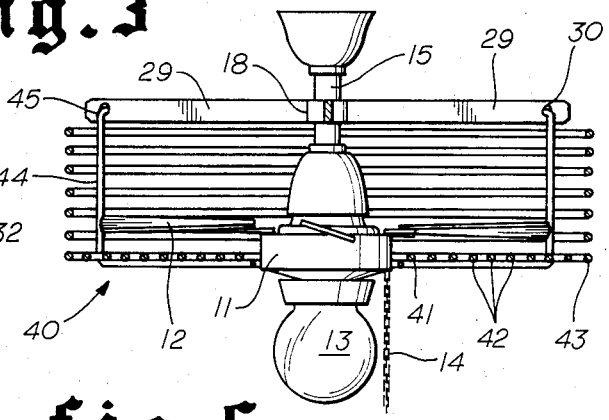
FIG. 6 is a view in side elevation, in partial cross section, of one embodiment of the ceiling fan guard installed on a conventional ceiling fan.
Figures 5, 7, 9:
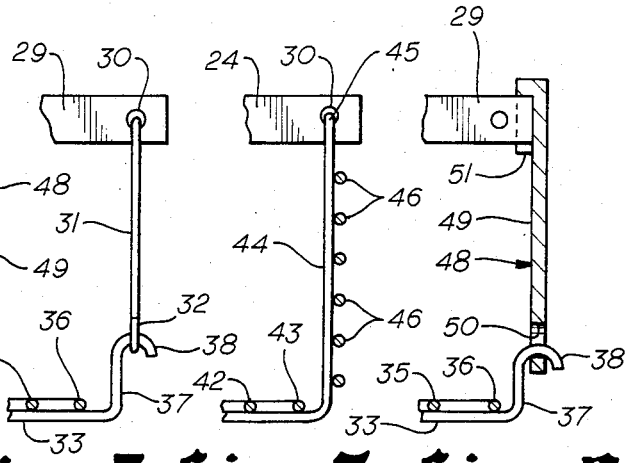
FIG. 5 is a detail view showing of the suspension elements of the ceiling fan guard embodiment of FIG. 1.
FIG. 7 is a detail view showing of the suspension elements of the ceiling fan guard embodiment of FIG. 6.
FIG. 9 is a detail view of the suspension elements of the ceiling fan guard embodiment of FIG. 8.

In FIGS. 6 and 7, there is shown an alternate embodiment of the ceiling fan guard. In this embodiment, circular grill 40 comprises a central ring 41 and a series of concentrically spaced rings 42 extending radially outward therefrom and terminating in an outer ring 43. Three circumferentially spaced connecting wires 44 extend from the central ring 41 across each of the rings 42 to the outer ring 43 and are secured thereto by suitable means such as welding.

Each of the extended outer ends of the connecting wires 44 extends vertically upwardly from the outer ring 43 and terminates in a hook 45 which is received in the openings 30 at the ends of the support arms 29. A series of parallel, axially-aligned, peripheral rings 46 are spaced vertically from the outer ring 43 to the top hooked portion of the connecting wires 44 and are secured thereto by suitable means such as welding. In this embodiment, the circular grill 40 is rigidly suspended below the fan blades 12 and provided with an open outer skirt portion.

Figure 8:
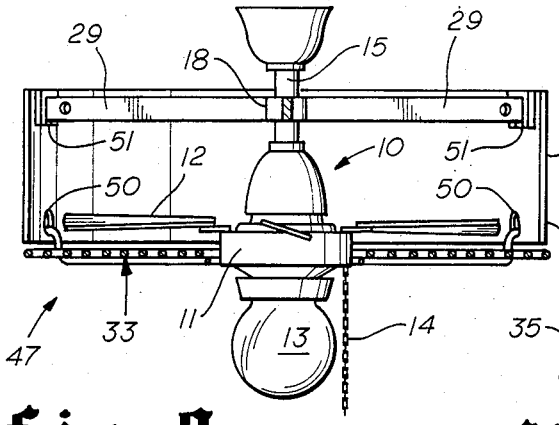
FIG. 8 is a view in side elevation, in partial cross section, of another embodiment of the ceiling fan guard installed on a conventional ceiling fan.

In FIGS. 8 and 9 there is shown an alternate embodiment of the fan guard 47 having a cylindrical peripheral skirt 48 utilizing the same circular grill 33 as in the embodiment of FIG. 1. The peripheral skirt 48 comprises a cylindrical ring 49 formed of sheet metal or other suitable material extending downward from support arms 29 to a point below the fan blades 12. Each of the outer ends of the connecting wires 37 extend vertically upwardly from the outer ring 36 and terminates in a hook 38 which is received in openings 50 in the lower edge portion of the skirt 48.

A series of circumferentially-spaced, vertical slots 51 having closed top portions are provided on the inner surface of skirt 48. The slots 51 are axially aligned with the ends of support arms 29. To install the skirt 48, it is rotated so that the slots 51 are not aligned with the arms 29 and lifted so that the slots clear the arms, then it is rotated to align the slots with the arms and lowered into position with the ends of the arms received in the slots. In this embodiment, the circular grill 33 is suspended below the fans blades 12 in a fixed position and has a solid open ended peripheral skirt portion.

While this invention has been described fully and completely with special emphasis upon several preferred embodiments, it should be understood that within the scope of the appended claims the invention may be practiced otherwise than as specifically described herein.

I claim:

1. The combination with a ceiling fan suspended from a ceiling by a pipe attached to the ceiling at one end and attached at the other end to the motor of such fan of a guard comprising;

a clamp fitting tightly around and releasably connected to the pipe suspending said ceiling fan at a point below the ceiling and above said motor and being the sole support of said guard, circumferentially spaced supporting arms with unsupported ends extending radially outward from said clamp and terminating beyond the blades of said fan, a circular grill member supported from said support arms below the blades of said fan and extending peripherally outward beyond the ends of said blades, and supporting means releasably attached to said supporting arms at one end and at the other end to said grill member.

2. A fan-guard combination according to claim 1 in which said supporting means includes a circumferentially open skirt portion interconnecting said supporting arms and said grill member.

3. A fan-guard combination according to claim 2 in which said open skirt portion comprises a series of parallel, axially-aligned rings positioned between said supporting arms and said grill member on the periphery of said supporting means in a vertically spaced relation, means supporting said rings and secured on said supporting means.

4. A fan-guard combination according to claim 1 in which said supporting means includes a circumferentially-extending, peripherally-enclosed skirt portion interposed between said supporting arms and said grill member.

5. A fan-guard combination according to claim 4 in which said enclosed skirt portion comprises a cylinder of sheet material extending downward from said supporting arms to a point below said fan blades, means on the lower edge portion of said skirt receiving and supporting said grill member, and a series of circumferentially-spaced, vertical slots having closed top portions positioned on the inner surface of said skirt in axial alignment with the extended ends of said supporting arms and slidably receiving the same.

6. A fan-guard combination according to claim 1 in which said circular grill member includes a removable portion for adapting said fan guard to receive selected depending portions of said ceiling fan.

7. A fan-guard combination according to claim 1 in which said clamping means comprises a two-piece cylindrical clamp having first and second semi-cylindrical segments, means on said clamp segments connecting the same releasably around said fan motor suspension pipe.

8. A fan-guard combination according to claim 7 in which said clamp includes means for adapting the same to fit different sizes of fan motor suspension pipes.

9. A fan-guard combination according to claim 8 in which said first semi-cylindrical segment has an opening at one end, said second semi-cylindrical segment has a tongue at one end fitting into and forming a hinge with said opening in said first segment, the other ends of said segments having holes therein, means secured in said holes to clamp said segments together around said fan supporting pipe, and said adapting means comprises a set screw.

10. A fan-guard combination according to claim 7 in which said first semi-cylindrical segment has an opening at one end, said second semi-cylindrical segment has a tongue at one end fitting into and forming a hinge with said opening in said first segment, the other ends of said segments having holes therein, and means secured in said holes to clamp said segments together around said fan supporting pipe.

11. A fan-guard combination according to claim 7 in which said clamping means further includes a section of material insertable between said segments and said suspension member for preventing damage to said pipe.

12. A fan-guard combination according to claim 1 in which said supporting arms comprise at least three circumferentially spaced arms extending radially outward from said clamping means, having a fixed end and a distal end, and each of said arms having an opening at its distal end to receive one end of said supporting means.

13. A fan-guard combination according to claim 1 in which said circular grill comprises a plurality of concentrically spaced rings in the same horizontal plane, a plurality of equally spaced radially rods extending from the central ring across each of said concentrically spaced rings to the outermost ring and secured thereto, and means on said outer ring secured to said supporting means.

14. A fan-guard combination according to claim 1 in which said supporting means comprises wire members each having at least one hooked end secured on each of said supporting arms.

15. A fan-guard combination according to claim 1 in which said supporting means comprises wire members each having at least one hooked end secured to and supporting said grill member.

16. A guard for a ceiling fan suspended from a ceiling by a pipe attached at one end to the ceiling and at the other end to the fan motor, comprising;

a clamp adapted to fit tightly around said suspending pipe to releasably connect said guard to said pipe at a point below the ceiling and above said motor and being the sole support of said guard, circumferentially spaced supporting arms with unsupported ends extending radially outward from said clamp and terminating beyond the blades of said fan when installed thereon, a circular grill member supported from said support arms below the blades of said fan when installed thereon and extending peripherally outward beyond the ends of said blades, and supporting means releasably attached to said supporting arms at one end and at the other end to said grill member.

17. A guard according to claim 16 in which said supporting means includes a circumferentially open skirt portion interconnecting said supporting arms and said grill member.

18. A guard according to claim 17 in which said open skirt portion comprises a series of parallel, axially-aligned rings positioned between said supporting arms and said grill member on the periphery of said supporting means in a vertically spaced relation, means supporting said rings and secured on said supporting means.

19. A guard according to claim 17 in which said supporting means includes a circumferentially-extending, peripherally-enclosed skirt portion interposed between said supporting arms and said grill member.

20. A guard according to claim 19 in which said enclosed skirt portion comprises a cylinder of sheet material extending downward from said supporting arms to a point below said fan blades when installed on said fan support, means on the lower edge portion of said skirt receiving and supporting said grill member, and a series of circumferentially-spaced, vertical slots having closed top portions positioned on the inner surface of said skirt in axial alignment with the extended ends of said supporting arms and slidably receiving the same.

21. A guard according to claim 16 in which said circular grill member includes a removable portion for adapting said fan guard to receive selected depending portions of said ceiling fan when installed on said fan support.

22. A guard according to claim 16 in which said clamping means comprises a two-piece cylindrical clamp having first and second semi-cylindrical segments, means on said clamp segments adapted to connect the same releasably around said fan motor suspension pipe.

23. A guard according to claim 22 in which said clamp includes means for adapting the same to fit different sizes of fan motor suspension pipes.

24. A guard according to claim 23 in which said first semi-cylindrical segment has an opening at one end, said second semi-cylindrical segment has a tongue at one end fitting into and forming a hinge with said opening in said first segment, the other ends of said segments having holes therein, means secured in said holes adapted to clamp said segments together around said fan supporting pipe, and said adapting means comprises a set screw.

25. A guard according to claim 22 in which said first semi-cylindrical segment has an opening at one end, said second semi-cylindrical segment has a tongue at one end fitting into and forming a hinge with said opening in said first segment, the other ends of said segments having holes therein, and means secured in said holes adapted to clamp said segments together around said fan supporting pipe.

26. A guard according to claim 22 in which said clamping means further includes a section of material insertable between said segments and said suspension member for preventing damage to said pipe.

27. A guard according to claim 16 in which said supporting arms comprise at least three circumferentially spaced arms extending radially outward from said clamping means, having a fixed end and a distal end, and each of said arms having an opening at its distal end to receive one end of said supporting means.

28. A guard according to claim 16 in which said circular grill comprises a plurality of concentrically spaced rings in the same horizontal plane, a plurality of equally spaced radially rods extending from the central ring across each of said concentrically spaced rings to the outermost ring and secured thereto, and means on said outer ring secured to said supporting means.

29. A guard according to claim 16 in which said supporting means comprises wire members each having at least one hooked end secured on each of said supporting arms.

30. A guard according to claim 16 in which said supporting means comprises wire members each having at least one hooked end secured to and supporting said grill member.

* * * * *